US010534385B2

(12) United States Patent
Singh

(10) Patent No.: US 10,534,385 B2
(45) Date of Patent: Jan. 14, 2020

(54) VOLTAGE REGULATOR WITH FAST TRANSIENT RESPONSE

(71) Applicant: Qorvo US, Inc., Greensboro, NC (US)

(72) Inventor: Gaurav Singh, Eindhoven (NL)

(73) Assignee: Qorvo US, Inc., Greensboro, NC (US)

( * ) Notice: Subject to any disclaimer, the term of this patent is extended or adjusted under 35 U.S.C. 154(b) by 0 days.

(21) Appl. No.: 15/847,858

(22) Filed: Dec. 19, 2017

(65) Prior Publication Data

US 2018/0173258 A1 Jun. 21, 2018

Related U.S. Application Data

(60) Provisional application No. 62/435,975, filed on Dec. 19, 2016.

(51) Int. Cl.

| | |
|---|---|
| ***G05F 1/575*** | (2006.01) |
| ***G05F 1/46*** | (2006.01) |
| ***G05F 1/565*** | (2006.01) |

(52) U.S. Cl.
CPC ..... *G05F 1/461* (2013.01); *G05F 1/565* (2013.01); *G05F 1/575* (2013.01)

(58) Field of Classification Search
CPC ..... G05F 1/461; G05F 1/565; G05F 1/575
See application file for complete search history.

(56) References Cited

U.S. PATENT DOCUMENTS 7,843,180 B1 * 11/2010 Cilingiroglu ..... G05F 1/575 323/273
2010/0315158 A1 * 12/2010 Atrash ..... G05F 1/565 327/541

(Continued)

OTHER PUBLICATIONS

Ahuja, B.K., "An Improved Frequency Compensation Technique for CMOS Operational Amplifiers," IEEE Journal of Solid-State Cicruits, vol. 18, Issue 6, Dec. 1983, pp. 629-633.

(Continued)

*Primary Examiner* — Yusef A Ahmed
*Assistant Examiner* — Ishrat F Jamali
(74) *Attorney, Agent, or Firm* — Withrow & Terranova, P.L.L.C.

(57) ABSTRACT

Voltage regulators with fast transient response are provided herein. According to one aspect, a voltage regulator for accepting an input voltage ($V_{REF}$) and producing an output voltage ($V_{ouT}$) includes an operational amplifier having as a first input ($V_{REF}$) and having as a second input a feedback voltage ($VF_B$); an output amplifier having an input coupled to the output of the operational amplifier and an output that produces $V_{OUT}$, the output being coupled to a feedback path that produces $VF_B$; a compensation capacitor (Cc) connected between the output of the output amplifier and an input to a buffer amplifier that supplies a voltage to the input of the output amplifier. The buffer amplifier has a transconductance ($gm_{BUF}$) that is controlled to be proportional to a load current ($I_{LOAD}$), thereby causing the left hand plane zero of the buffer amplifier to cancel the pole created by the output amplifier.

8 Claims, 6 Drawing Sheets

(56) References Cited

U.S. PATENT DOCUMENTS

2014/0117958 A1* 5/2014 Price ..... G05F 1/575
323/281
2017/0315574 A1* 11/2017 Brown ..... G05F 1/575

OTHER PUBLICATIONS

Al-Shyoukh, Mohammad, et al., "A Transient-Enhanced Low-Quiescent Current Low-Dropout Regulator with Buffer Impedence Attenuation," IEEE Journal of Solid-State Circuits, vol. 42, Issue 8, Aug. 2007, pp. 1732-1742.
Furth, Paul, et al., "Low Droppout (LDO) Voltage Regulator Design Using Split-Length Compensation," Midwest Symposium on Circuits and Systems, Aug. 2012, Boise, Idaho, IEEE, pp. 1088-1091.
Garimella, Annajirao, et al., "Frequency Compensation Techniques for Op-Amps and LDOs: A Tutorial Overview," International Midwest Symposium on Circuits and Systems, Aug. 2011, IEEE, 4 pages.
Saxena, Vishal, et al., "Compensation of CMOS Op-Amps Using Split-Length Transistors," Midwest Symposium on Circuits and Systems, Aug. 2008, IEEE, pp. 109-112.
Williams, Jim, "Load Transient Response Testing for Voltage Regulators: Practical Considerations for Testing and Evaluating Results," Linear Technology, Application Note 104, Oct. 2006, 16 pages.

* cited by examiner

VOLTAGE REGULATOR WITH FAST TRANSIENT RESPONSE

RELATED APPLICATIONS

This application claims the benefit of provisional patent application Ser. No. 62/435,975, filed Dec. 19, 2016, the disclosure of which is hereby incorporated herein by reference in its entirety.

FIELD OF THE DISCLOSURE

Embodiments of the present disclosure relate generally to the field of circuits, and more particularly to a voltage regulator circuit.

BACKGROUND

Voltage regulators accept an input voltage ($V_{IN}$) and produce a regulated output voltage ($V_{OUT}$). In an ideal voltage regulator, the desired $V_{OUT}$ will be output by the regulator, so long as $V_{IN}$ is greater than or equal to $V_{OUT}$. In real circuits, however, there is some voltage drop across the regulator—i.e., between $V_{IN}$ and $V_{OUT}$—and so $V_{IN}$ must be greater than $V_{OUT}$ by at least this voltage drop. The minimum voltage required across the regulator to maintain regulation is referred to as the "dropout voltage." Thus, in order for a voltage regulator having a dropout voltage of $V_{DO}$ to provide an output voltage of $V_{OUT}$, $V_{IN}$ must be at least $V_{OUT}+V_{DO}$.

A Low-Dropout Voltage Regulator (which may be referred to herein as "an LDO voltage regulator," "an LDO regulator," or simply "an LDO") is one that can regulate the output voltage even when the supply voltage is very close to the output voltage: when $V_{DO}$ is small, $V_{IN}$ can be very close to $V_{OUT}$ and the regulator will still operate correctly.

FIG. 1 is a circuit schematic of a conventional LDO voltage regulator 10. A typical LDO 10 uses an operational amplifier, or "op amp," 12 to drive the control terminal of a Bipolar Junction Transistor (BJT) or Field-Effect Transistor (FET) device 14. Thus, a generic LDO 10 can be considered to be a two-stage amplifier consisting of a so-called Error Amplifier (EA) stage and an output (OUT) stage. In complementary Metal Oxide Semiconductor (MOS) process, the output stage is usually a MOS transistor, the impedance of which is controlled by the feedback loop in order to regulate the voltage at its drain. Therefore, such a regulator can be considered to be a two-stage voltage feedback amplifier.

In the conventional LDO 10 illustrated in FIG. 1, the op amp 12 may also be referred to as the error amp 12, and has a transconductance value ($gm_{EA}$), while the FET 14 may also be referred to as the output amp 14, and has a transconductance value ($gm_{OUT}$). The amplifier feedback signal ($A_{FB}$) is provided by a voltage divider 16, comprising a resistor ladder with resistors R1 and R2 connected in series to provide a feedback voltage ($V_{FB}$) to one of the input terminals of the op amp 12. The op amp 12 has an output resistance represented in FIG. 1 as a shunt resistance ($Ro_{EA}$). The load at the output of the LDO 10 is represented in FIG. 1 by a load resistance $R_{LOAD}$ and an output capacitance ($C_{OUT}$). A reference voltage ($V_{REF}$) is provided as the input to the LDO 10 and is connected to another of the input terminals of the op amp 12

The transfer function of such a system usually includes two poles: a first pole at the output of the first amplifier stage (P1) and a second pole at the output of the second stage (P2). In the absence of compensation, these two poles are not greatly separated in frequency; thus, some compensation is needed to stabilize the system. Further, the location of the output pole (P2) in a voltage regulator is directly proportional to the load current. A typical LDO 10 is required to support a large dynamic range of load currents, which creates an additional challenge in stabilizing the system. See Equations (1) and (2).

$$R_{LOAD} = \frac{V_{OUT}}{I_{LOAD}} \quad \text{EQ. (1)}$$

$$P2 = \frac{1}{R_{LOAD}C_{out}} \propto \frac{I_{load}}{C_{out}} \quad \text{EQ. (2)}$$

where $V_{OUT}$ is the output voltage of the LDO 10 and $I_{LOAD}$ is the load current at the output terminal.

Several solutions have been disclosed in the past to stabilize a LDO 10. One form of compensation is called Miller compensation and involves placing a compensation capacitor (Cc) across the output stage (e.g., the FET 14) of the LDO 10. This compensation capacitor splits the two poles, whereby the dominant pole at P1 is moved to a lower frequency, and the pole at the output (P2) is moved to a higher frequency, thereby stabilizing the system. This is shown in FIG. 2.

FIG. 2 is a graph of the frequency response of the conventional LDO with Miller compensation. A well-known issue with Miller compensation, however, is that the compensation capacitor (Cc) creates a zero in the Right Half Plane (RHP), which may reduce stability.

FIG. 3 is a circuit schematic of a conventional Miller-compensated LDO 18 that uses a nulling resistor ($R_Z$) in series with the compensation capacitor (Cc) to solve the RHP zero problem. To support a large dynamic range of load currents, the compensation capacitor ($C_C$) must be chosen to be large enough for the system to be stable for the lowest load current. This has a negative effect on the bandwidth and transient response of the conventional Miller-compensated LDO 18.

FIG. 4 is a circuit schematic of a conventional Miller-compensated LDO 20 that uses a current buffer 22 in series with the compensation capacitor (Cc) to solve the RHP zero problem in a more robust way. This current buffer 22 eliminates the forward path and hence the RHP zero as shown in FIG. 4. A common implementation of such a circuit is also called "Ahuja compensation" or "cascode compensation". Another advantage of this compensation technique is that it introduces a Left Half Plane (LHP) zero, which further helps in stabilizing the system. See also Equation (3).

$$LHP_{zero} = -\frac{gm_{CG}}{C_c} \quad \text{EQ. (3)}$$

where $gm_{CG}$ is the transconductance of the P-Type MOS (PMOS) transistor that connects the output of the error amplifier 12 to the compensation capacitor having a capacitance value (Cc). FIG. 4 also shows the equivalent circuit of the current buffer 22 and compensation capacitor (Cc): the current buffer 22 operates as a resistor to ground having an impedance of $1/gm_{CG}$. The frequency of the zero introduced by the current buffer 22 is a function of the values of the transconductance ($gm_{CG}$) and the capacitance (Cc).

FIG. 5 is a circuit schematic of a conventional Miller-compensated LDO 24 that uses another method for solving the RHP zero issue in Miller compensation, which is to use the so-called split-length MOS compensation. In this approach, an error amplifier 26 includes a low-impedance node created by splitting a MOS transistor—for instance, one of the input MOS pair of a conventional op amp—and placing each part in series. In FIG. 5, one of the pair of input MOS transistors has been split into two MOS transistors connected in series, $Mn_{1A}$ and $Mn_{1B}$, while the other of the pair of input MOS transistors has been split into another two MOS transistors connected in series, $Mn_{2A}$ and $Mn_{2B}$. For each set of series connected MOS transistors, the gates of the two series-connected MOS transistors are connected together. As a result, the MOS transistor placed at the source side ($Mn_{2B}$) is in triode mode and has a transconductance of gm; its impedance can be approximated to 1/gm. The MOS transistor ($Mn_{2A}$) operates as a buffer amplifier 28 and has a transconductance of $gm_{BUF}$.

The compensation capacitor (Cc) is placed at the low-impedance node between the two MOS transistors in series, e.g., between $Mn_{2A}$ and $Mn_{2B}$ in FIG. 5. This splitting of MOS transistors results in effectively nulling the RHP zero and introducing a LHP zero, which is at a frequency proportional to $gm_{BUF}/C_c$.

The cascode compensation (Ahuja compensation) and split-length MOS compensation techniques are sometimes grouped together and referred to as indirect Miller compensation. They are referred to as such in the remainder of the present disclosure.

FIG. 6 represents a general indirect Miller-compensated LDO 30 that contains the error amplifier 26, the output amplifier 14, and the buffer amplifier 28. The amplitude of the feedback signal will be some fraction of the output voltage ($V_{OUT}$); this is represented in FIG. 6 by voltage divider 16, which may represent a resistor ladder or other circuit that provides a feedback signal with amplitude ($V_{OUT}/M$). Each amplifier drawn can consist of one or more stages. As discussed previously, this system has two main poles: P1 at the output of the first amplifier stage and P2 at the output of the second amplifier stage.

However, the output pole (P2) of this system varies with load current, and because of this, the dominant pole (P1) needs to be at a relatively low frequency in order to avoid instability in the LDO 30. In addition, the transconductance of the buffer amplifier 28, $gm_{BUF}$, introduces a LHP zero that is located at $gm_{BF}/C_c$. See also Equations (4) to (6).

$$P1 \propto \frac{Rout_{EA}}{A_{OUT}Cc} \quad \text{EQ. (4)}$$

$$P2 \propto \frac{I_{LOAD}}{Cc} \quad \text{EQ. (5)}$$

$$LHP_{zero} = -\frac{gm_{BUF}}{C_c} \quad \text{EQ. (6)}$$

where $Rout_{EA}$ is the output resistance of the error amplifier 26, $A_{OUT}$ is the gain of the output amplifier 14, and (Cc) is the value of the compensation capacitor.

In summary, Miller compensation and its variants have a fundamental drawback in terms of limitation placed on the bandwidth of the system: because the output pole varies with load, the dominant pole has to be at a lower frequency than desired. This affects both the wideband power supply rejection ratio and transient response of the LDO, where stability needs to be ensured for a wide dynamic range of load currents.

SUMMARY

The present disclosure relates to a voltage regulator, specifically a LDO designed for fast transient response and a high power supply rejection ratio across a wide frequency bandwidth while consuming low quiescent current. This is achieved by using an improved compensation technique for stabilizing the LDO. The compensation technique of the present disclosure eliminates the restriction on amplifier bandwidth imposed by the traditional Miller compensation and is suitable for application in a voltage regulator in which the output pole varies inversely proportionally to the load currents.

According to one aspect of the present disclosure, a voltage regulator for accepting an input voltage ($V_{REF}$) and producing an output voltage ($V_{OUT}$) comprises: an operational amplifier having a first input, a second input, and an output, the first input accepting the input voltage ($V_{REF}$); an output amplifier having an input coupled to the output of the operational amplifier and an output that produces $V_{OUT}$, the output being coupled to a feedback path that produces a feedback voltage ($V_{FB}$) that is applied to the second input of the operational amplifier; a compensation capacitor (Cc) having a first terminal and a second terminal, the first terminal coupled to the output of the output amplifier; and a buffer amplifier having an input coupled to the second terminal of the compensation capacitor (Cc), and having an output coupled to the input of the output amplifier, the buffer amplifier having a transconductance ($gm_{BUF}$) that is controlled to be proportional to a load current ($I_{LOAD}$).

In some embodiments, $gm_{BUF}$ is proportional to a bias current $I_{BIAS}$ being supplied to the buffer amplifier and $I_{BIAS}$ being supplied to the buffer amplifier is proportional to a load current ($I_{LOAD}$).

In some embodiments, the operational amplifier introduces a first pole (P1), the output amplifier introduces a second pole (P2), the buffer amplifier introduces a left hand plane zero ($LHP_{ZERO}$), and the transconductance ($gm_{BUF}$) is controlled such that $LHP_{ZERO}$ cancels P2.

In some embodiments, $$gm_{BUF} = \frac{2 * I_{bias}}{V_{gs} - V_t}$$

and $I_{BIAS}$ is controlled such that $LHP_{ZERO}$ cancels P2.

In some embodiments, $I_{BIAS}$ is provided according to the equation $$I_{bias} = \frac{(V_{gs} - V_t)}{2\ V_{out}} I_{LOAD}.$$

According to another aspect of the present disclosure, a voltage regulator for accepting an input voltage ($V_{REF}$) and producing an output voltage ($V_{OUT}$) comprises: a PMOS transistor (M1) having a source, drain, and gate, the source being coupled to a first supply ($V_{SUPPLY}$); a PMOS transistor (M2) having a source, drain, and gate, the source coupled to ($V_{SUPPLY}$) and the gate being coupled to the gate of M1; a first current source having a first terminal and a second terminal, the second terminal being coupled to ground, the first current source providing a bias current ($I_{BIAS}$); an N-Type MOS (NMOS) transistor ($Mn_{1A}$) having a source, drain, and gate, the drain being coupled to the drain of M1 and the gate being provided with a voltage ($V_{FB}$); an NMOS transistor ($Mn_{1B}$) having a source, drain, and gate, the drain being coupled to the source of $Mn_{1A}$, the gate being provided with the voltage ($V_{FB}$), and the source being coupled to the first terminal of the first current source; an NMOS transistor ($Mn_2$) having a source, drain, and gate, the drain being coupled to the drain of M2 and the gate being provided with the voltage ($V_{REF}$); an NMOS transistor ($Mn_{2B}$) having a source, drain, and gate, the drain being coupled to the source of $Mn_{2A}$, the gate being provided with the voltage ($V_{REF}$), and the source being coupled to the first terminal of the first current source; a PMOS transistor ($M_{OUT}$) having a source, drain, and gate, the source being coupled to $V_{SUPPLY}$, the gate being coupled to the drain of M2, and the drain being coupled to an output terminal for producing $V_{OUT}$; a second current source having a first terminal and a second terminal, the first terminal being coupled to the output terminal and the second terminal being coupled to ground, the second current source providing a load current ($I_{LOAD}$); a compensation capacitor (Cc) having a first terminal being coupled to the output terminal and a second terminal being coupled to the drain of $Mn_{2B}$; and a feedback circuit having an input terminal coupled to the output terminal and an output terminal that produces $V_{FB}$; wherein $I_{BIAS}$ is proportional to $I_{LOAD}$.

In some embodiments, $$I_{bias} = \frac{(V_{gs} - V_t)}{2\ V_{out}} I_{LOAD},$$

wherein $V_{gs}$ is the gate-source voltage of transistors $Mn_{1A}$ and $Mn_{2A}$ and $V_t$ is the threshold voltage of transistors $Mn_{1A}$ and $Mn_{2A}$.

In some embodiments, $I_{BIAS}$ is proportional to $I_{LOAD}$ according to the equation $I_{bias}=k*I_{LOAD}$.

In some embodiments, $$k = \frac{2 * I_{bias}}{I_{load}}.$$

In some embodiments, $$k = \frac{(V_{gs} - V_t)}{V_{out}},$$

wherein $V_{gs}$ is the gate-source voltage of transistors $Mn_{1A}$ and $Mn_{2A}$ and $V_t$ is the threshold voltage of transistors $Mn_{1A}$ and $Mn_{2A}$.

According to yet another aspect of the present disclosure, a voltage regulator for accepting an input voltage $V_{REF}$ and producing an output voltage $V_{OUT}$ comprises: a PMOS transistor M1 having a source, drain, and gate, the source being coupled to a first supply $V_{SUPPLY}$; a PMOS transistor M2 having a source, drain, and gate, the source coupled to $V_{SUPPLY}$ and the gate being coupled to the gate of M1; a first current source having a first terminal and a second terminal, the second terminal being coupled to ground; an NMOS transistor M3 having a source, drain, and gate, the drain being coupled to the drain of M1 and the gate being provided with a voltage $V_{BIAS}$; an NMOS transistor M4 having a source, drain, and gate, the drain being coupled to the drain of M2 and the gate being provided with the voltage $V_{BIAS}$; an NMOS transistor $Mn_{12}$ having a source, drain, and gate, the drain being coupled to the drain of M1, the gate being provided with a voltage $V_{FB}$, and the source being coupled to the first terminal of the first current source; an NMOS transistor $Mn_{22}$ having a source, drain, and gate, the drain being coupled to the drain of M2, the gate being provided with the voltage $V_{REF}$, and the source being coupled to the first terminal of the first current source; a second current source having a first terminal and a second terminal, the first terminal being coupled to the source of M3 and the second terminal being coupled to ground; a third current source having a first terminal and a second terminal, the first terminal being coupled to the source of M4 and the second terminal being coupled to ground; a PMOS transistor $M_{OUT}$ having a source, drain, and gate, the source being coupled to $V_{SUPPLY}$, the gate being coupled to the drain of M2, and the drain being coupled to an output terminal for producing $V_{OUT}$; a fourth current source having a first terminal and a second terminal, the first terminal being coupled to the output terminal and the second terminal being coupled to ground, the fourth current source providing a load current $I_{LOAD}$; a compensation capacitor (Cc) having a first terminal being coupled to the output terminal and a second terminal being coupled to the drain of $Mn_{2B}$; a feedback circuit having an input terminal coupled to the output terminal and an output terminal that produces $V_{FB}$; wherein the current produced by each of the first, second, and third current sources is proportional to $I_{LOAD}$.

In some embodiments, the current produced by first current source is $n*I_{LOAD}$, the current produced by the second current source is $m*I_{LOAD}$, and the current produced by the third current source is $m*I_{LOAD}$, where n is different from m.

In some embodiments, $$n = \frac{(V_{gs} - V_t)}{V_{out}},$$

wherein $V_{gs}$ is the gate-source voltage of transistors $Mn_{12}$ and $Mn_{22}$ and $V_t$ is the threshold voltage of transistors $Mn_{12}$ and $Mn_{22}$.

In some embodiments, $$m = \frac{(V_{gs} - V_t)}{2V_{out}},$$

wherein $V_{gs}$ is the gate-source voltage of transistors M3 and M4 and $V_t$ is the threshold voltage of transistors M3 and M4.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
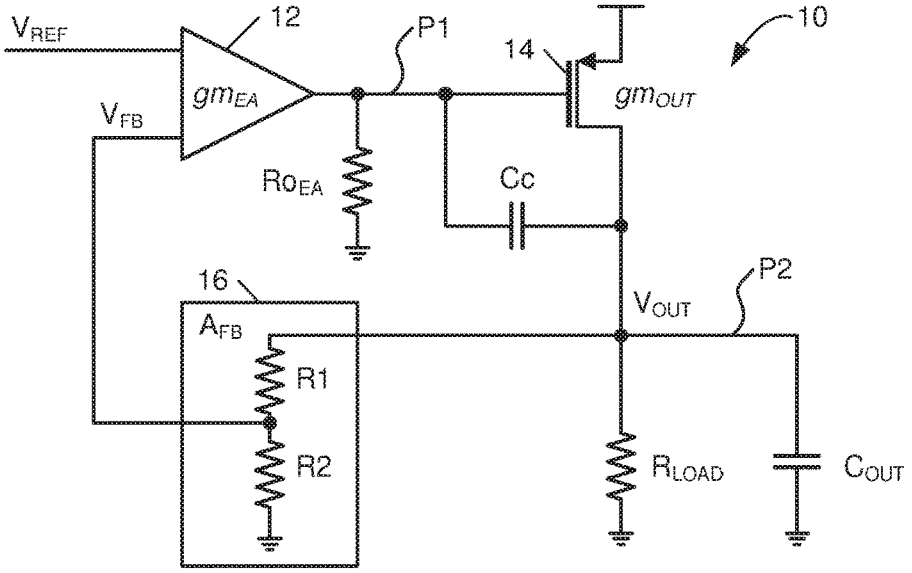
FIG. 1 (RELATED ART)
FIG. 1 is a circuit schematic of a conventional LDO voltage regulator with Miller compensation.
Figure 2:
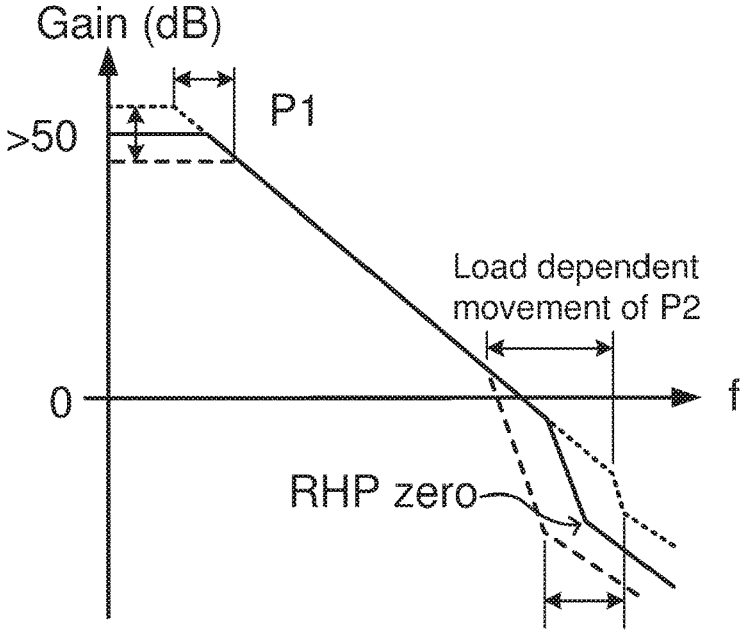
FIG. 2 (RELATED ART)
FIG. 2 is a graph of the frequency response of the conventional LDO showing load-dependent movement of P2.
Figure 3:
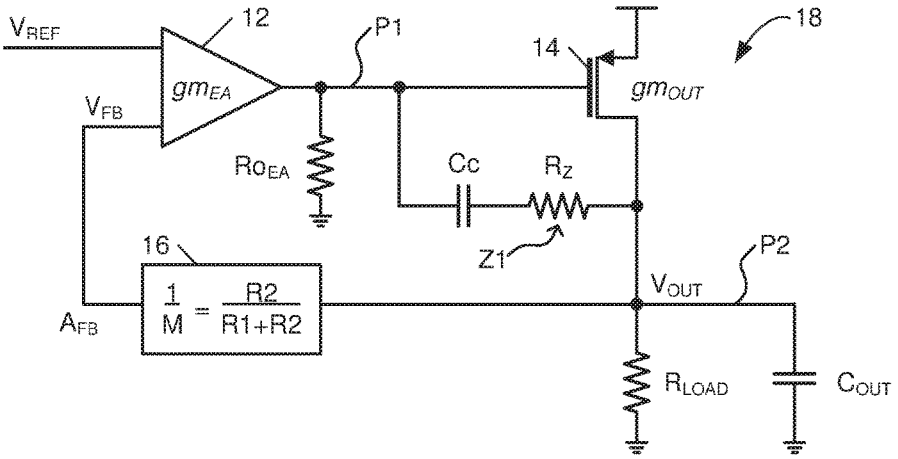
FIG. 3 (RELATED ART)
FIG. 3 is a circuit schematic showing a conventional Miller-compensated LDO with a nulling resistor.
Figure 4:
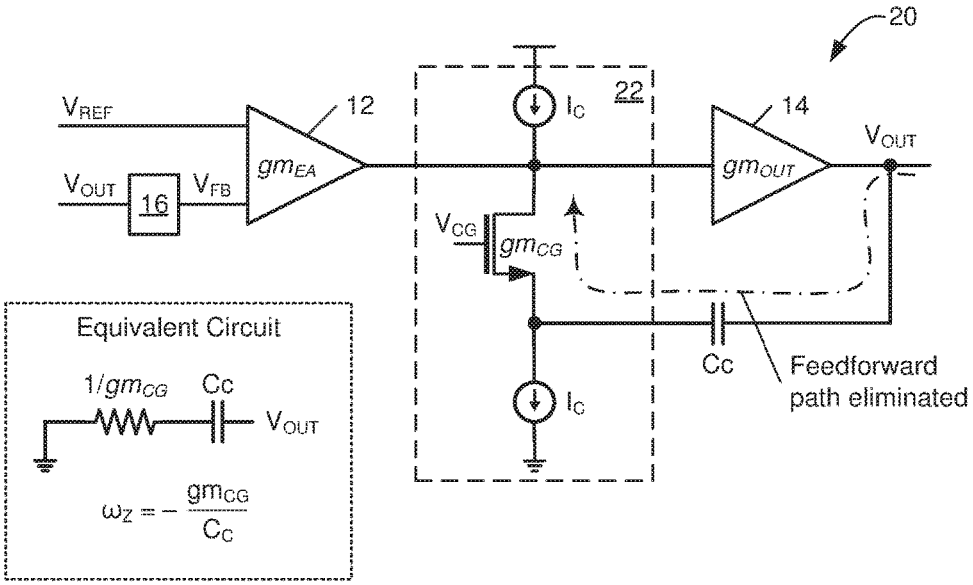
FIG. 4 (RELATED ART)
FIG. 4 is a circuit schematic showing a conventional Miller-compensated LDO with a current buffer (Ahuja compensation).
Figure 5:
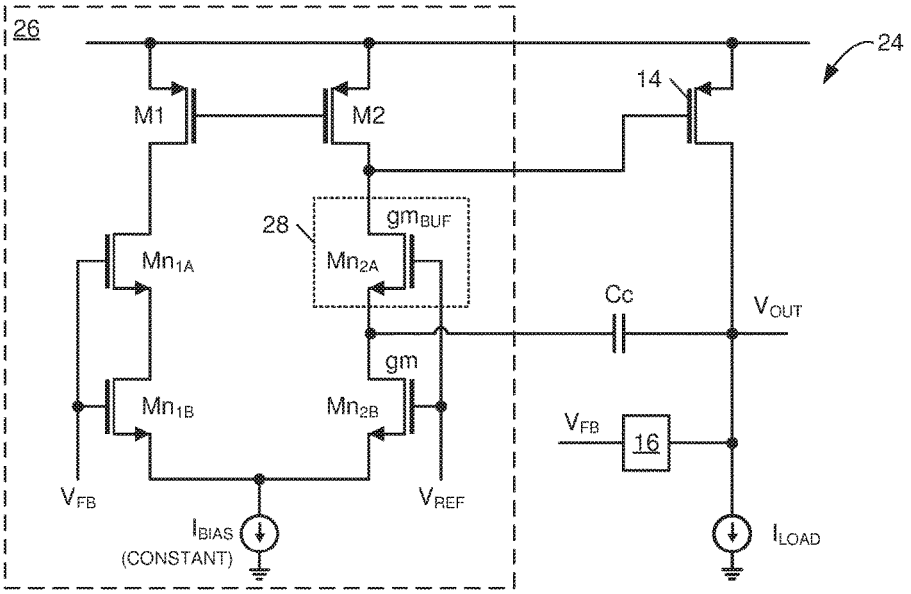
FIG. 5 (RELATED ART)
FIG. 5 is a circuit schematic showing a conventional Miller-compensated LDO with split-length MOS compensation.
Figure 6:
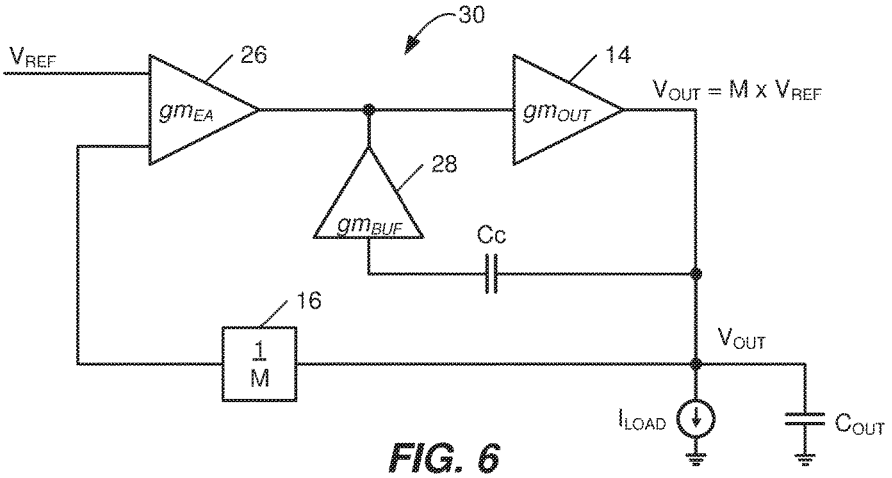
FIG. 6 (RELATED ART)
FIG. 6 is a simplified circuit schematic of a conventional LDO with indirect Miller compensation.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The technique of the present disclosure is in the field of integrated power supply, specifically in design of integrated LDOs that may or may not use an external (off-chip) capacitor. A few key design requirements for such a voltage regulator are the following: (a) low power dissipation (low quiescent current), (b) fast transient response, (c) high Power Supply Rejection Ratio (PSRR) in a wide bandwidth, and (d) stability over several decades of load current. These requirements can present contrasting design challenges since, for example, fast transient response requires high quiescent current and the traditional Miller compensation approach to stabilizing an LDO leads to low overall bandwidth. The technique of the present disclosure utilizes a stabilizing circuit that allows simultaneous fulfillment of the aforementioned design goals.

Figure 7:
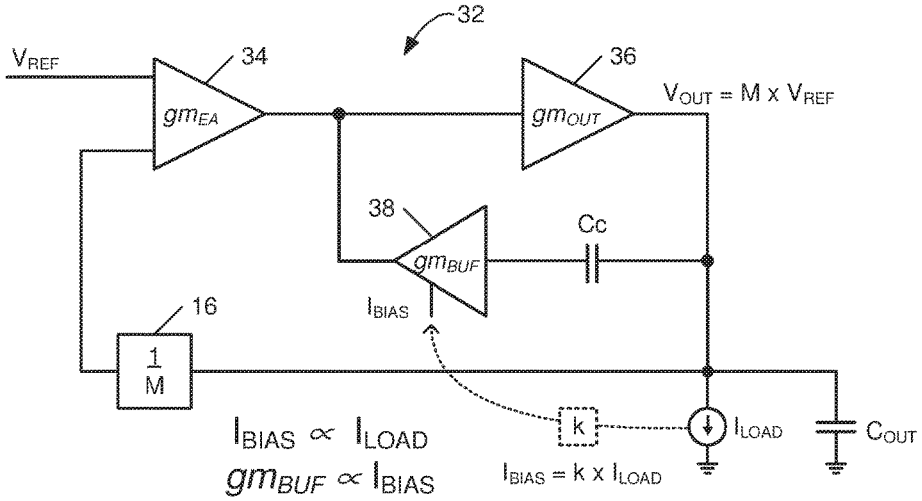
FIG. 7 is a circuit schematic showing an exemplary LDO voltage regulator having improved compensation according to one embodiment of the present disclosure.

FIG. 7 is a circuit schematic illustrating an exemplary LDO voltage regulator 32 having improved compensation according to an embodiment of the present disclosure. In the embodiment illustrated in FIG. 7, the LDO 32 includes an error amplifier 34, an output amplifier 36, the voltage divider 16, and an improved buffer amplifier 38. Each amplifier drawn can consist of one or more stages.

The technique of the present disclosure improves upon the traditional indirect Miller compensation techniques by removing the bandwidth limitation of the system. This is done by implementing the buffer amplifier 38 in such a way that the transconductance of this amplifier ($gm_{BUF}$) is proportional to the load current. By doing so, the frequency of LHP zero introduced by the buffer amplifier 38 is directly proportional to the load current and consequently proportional to the output pole (P2). In one embodiment, $gm_{BUF}$, Cc, and Cout are chosen in such a way that the LHP zero and P2 are placed close to each other, resulting in a cancellation of this pole-zero combination.

Figure 8:
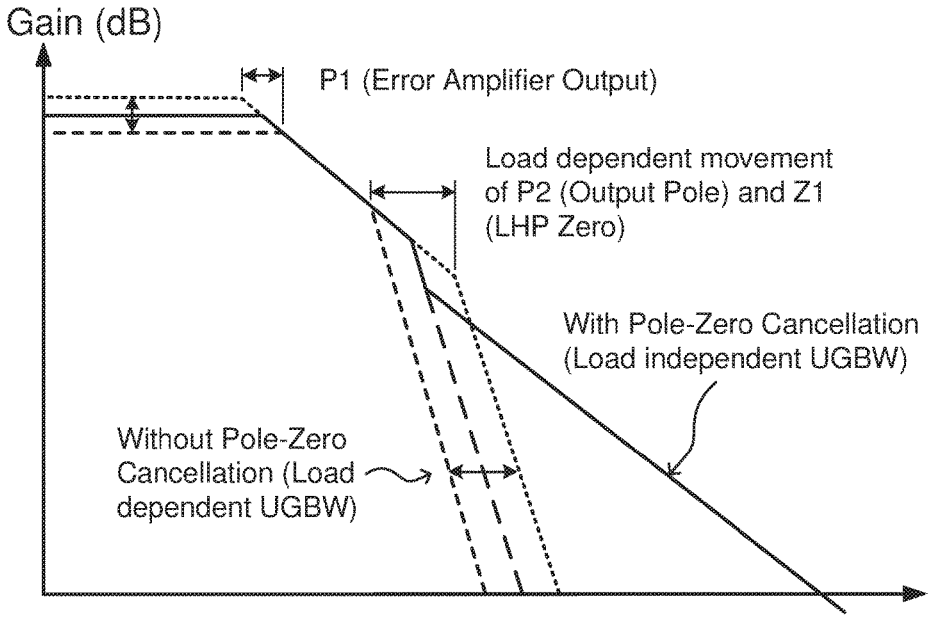
FIG. 8 is a graph of the frequency response of the exemplary LDO voltage regulator according to one embodiment of the present disclosure.

FIG. 8 is a graph of the frequency response of the exemplary LDO voltage regulator 32 according to one embodiment of the present disclosure. Because the LHP zero and the output pole track each other over several decades of load current, the stability condition over load current variations is much relaxed. Further, this pole-zero cancellation implies that P1 can be chosen to be higher and the Unity Gain Bandwidth (UGBW) of the system can be significantly higher. This results in faster transient response and higher PSRR bandwidth of the LDO 32.

Typically, the gm of a transistor is directly proportional to the bias current. For a transistor in saturation mode, this can be written in the form of the following equation:

$$gm = \frac{2 * I_{bias}}{V_{gs} - V_t} \quad \text{EQ. [7]}$$

Here, $I_{bias}$ represents the current through the drain of the transistor and may also be referred to as $I_{drain}$.

In one embodiment, $gm_{BUF}$ is designed to be proportional to the output load current. The equations for P2 and $LHP_{zero}$ are as follows in Equations (8) and (9):

$$P2 \cong \frac{I_{LOAD}}{V_{out}Cc} \quad \text{EQ. (8)}$$

$$LHP_{zero} = -\frac{2 * I_{bias}}{(V_{gs} - V_t)C_c} \quad \text{EQ. (9)}$$

Pole cancellation can be achieved by:

$$I_{bias} = \frac{(V_{gs} - V_t)}{2V_{out}} I_{LOAD} \quad \text{EQ. (10)}$$

This leads to the situation in which the output pole is first-order cancelled by the LHP zero introduced by the compensation buffer.

Figure 9:
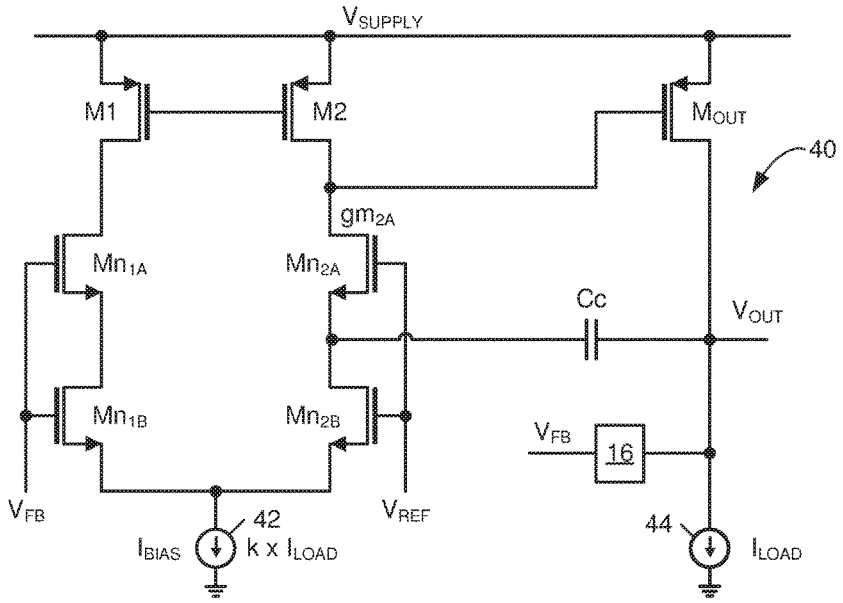
FIG. 9 is a circuit schematic showing one embodiment of the technique of the present disclosure using split-length MOS compensation.

FIG. 9 is a circuit schematic showing one embodiment of the technique of the present disclosure using split-length MOS compensation. In the embodiment illustrated in FIG. 9, an LDO 40 includes an error amplifier, which comprises transistors M1, M2, $Mn_{1A}$, $Mn_{1B}$, $Mn_{2A}$, $Mn_{2B}$, and a bias current source 42. The LDO 40 also includes an output amplifier comprising a transistor $M_{OUT}$. The LDO 40 is Miller-compensated, with a compensation capacitor (Cc), and the LHP zero is proportional to the transconductance of $Mn_{2A}(gm_{2A})$. The load capacitance seen at $V_{OUT}$ is represented by the capacitor ($C_{OUT}$), and the load current ($I_{LOAD}$) is represented by a current source 44.

In the embodiment illustrated in FIG. 9, the bias current produced by bias current source 42 is k times the load current ($I_{LOAD}$). In this manner, $gm_{2A}$ can be made proportional to the load current by using a current mirror to adaptively bias the first amplifier stage. FIG. 9 illustrates a differential implementation of the $gm_{BUF}$, therefore, the current $k*I_{LOAD}$ represents $2*I_{BIAS}$. Therefore, $$k = \frac{2 * I_{bias}}{I_{load}} \quad \text{EQ. (11)}$$

-continued $$k = \frac{(V_{gs} - V_t)}{V_{out}} \quad \text{EQ. (12)}$$

Here, $V_{gs}$ and $V_t$ refer to the gate-source voltage and the threshold voltage, respectively, of transistors $Mn_{2A}$ and $Mn_{1A}$. In the embodiment illustrated in FIG. 9, k=75.

Figure 10:
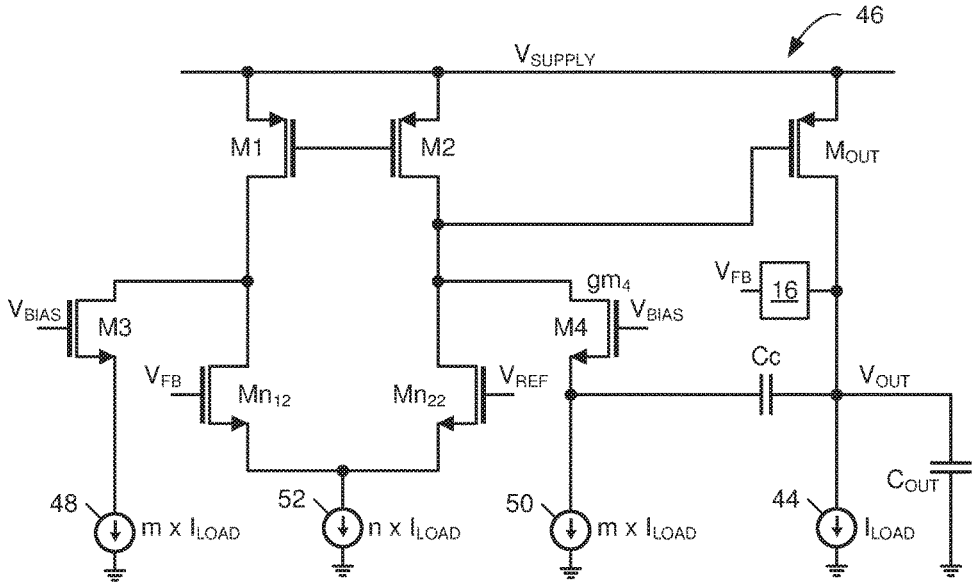
FIG. 10 is a circuit schematic showing another embodiment of the present disclosure using adaptively biased cascode compensation.

FIG. 10 is a circuit schematic showing another embodiment of the present disclosure using adaptively biased cascode compensation. In the embodiment illustrated in FIG. 10, an LDO 46 includes an error amplifier, which comprises transistors M1, M2, M3, M4, $Mn_{12}$, $Mn_{22}$, and bias current sources 48, 50, and 52. The LDO 46 also includes an output amplifier comprising a transistor $M_{OUT}$. The LDO 46 is Miller-compensated, with a compensation capacitor (Cc). The load capacitance seen at $V_{OUT}$ is represented by capacitor $C_{OUT}$ and the load current $I_{LOAD}$ is represented by a current source 44.

In the embodiment illustrated in FIG. 10, the LHP zero depends on the transconductance of M4 ($gm_4$), which can be made proportional to the load current $I_{LOAD}$ by using a bias current derived from a current mirror. In the embodiment illustrated in FIG. 10, each of the bias currents produced by bias current sources 48 and 50, respectively, are m times $I_{LOAD}$. Additionally, the bias current of the bias current source 52 can also be made proportional to the load current, which results in better efficiency without compromising transient performance. In the embodiment illustrated in FIG. 10, the bias current produced by the bias current source 52 is n times $I_{LOAD}$. Additionally, in this implementation the LHP zero can be controlled independently from the dominant pole location, which allows a degree of freedom in the design.

In the embodiment illustrated in FIG. 10, the transistors labeled 'M3' and 'M4' form the $gm_{BUF}$ stages for this implementation. Therefore, the equation derived (and repeated below) for relationship between the $gm_{BUF}$ and $I_{LOAD}$ would apply to these transistors $$I_{bias} = \frac{(V_{gs} - V_t)}{2V_{out}} I_{LOAD} \quad \text{EQ. (13)}$$

$$m = \frac{I_{bias}}{I_{LOAD}} \quad \text{EQ. (14)}$$

$$m = \frac{(V_{gs} - V_t)}{2V_{out}} \quad \text{EQ. (15)}$$

Here $V_{gs}$ and $V_t$ apply to the gate-source voltage and threshold voltage of the transistors M3 and M4.

Figure 11:
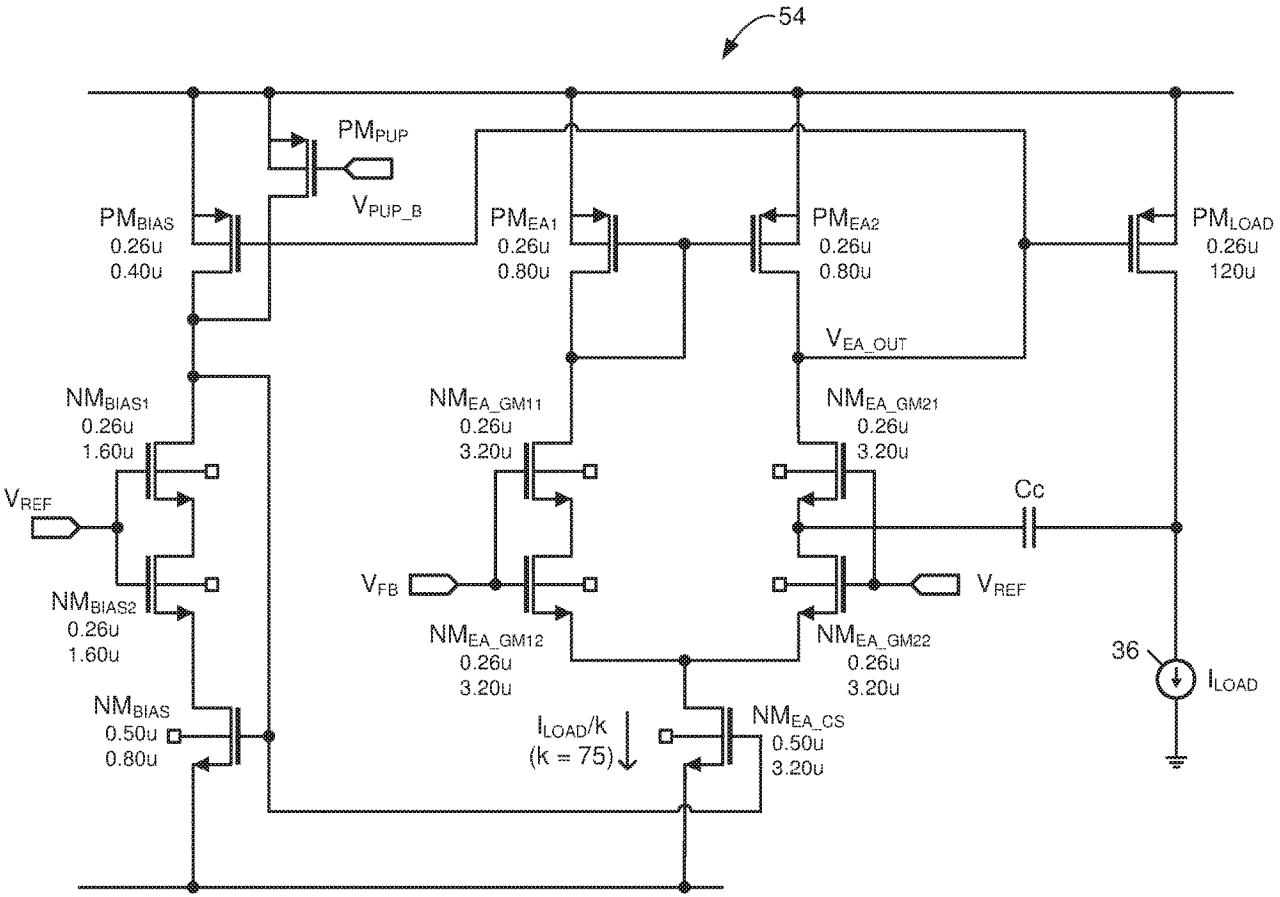
FIG. 11 is a circuit schematic showing another embodiment of the present disclosure.

FIG. 11 is a circuit schematic showing another embodiment of the present disclosure using adaptively biased cascode compensation. In an LDO 54 illustrated in FIG. 11, the current through the output transistor ($PM_{LOAD}$) is mirrored through a transistor ($PM_{BIAS}$). The current through $PM_{BIAS}$ is then mirrored to the current source below the differential pair of the error amplifier, $NM_{EA_CS}$. Each transistor in FIG. 11 is labeled with a name, the length of the transistor, and the width of the transistor. For example, in the embodiment illustrated in FIG. 11, the transistor ($PM_{BIAS}$) has a length of 0.26 μm and a width of 0.40 μm.

Thus, the current flowing through $NM_{EA_CS}$ is proportional to the current through $PM_{LOAD}$, which is represented as current "$I_{LOAD}$" in FIG. 11. Specifically, in the embodiment illustrated in FIG. 11, the current through $NM_{EA_CS}$ is approximately $I_{LOAD}/k$, where the value of "k" is 75. The subject matter described herein is not limited to just that value, however. Other values are contemplated for k, m, n, etc. The performance of an LDO voltage regulator is improved so long as $gm_{BUF}$ is proportional to $I_{LOAD}$ (in any proportion) when compared to the performance of an LDO voltage regulator having a $gm_{BUF}$ that is static (i.e., not proportional to $I_{LOAD}$), regardless of whether the transistor is in saturation mode or in some other mode.

Those skilled in the art will recognize improvements and modifications to the present disclosure. All such improvements and modifications are considered within the scope of the concepts disclosed herein.

What is claimed is:

1. A voltage regulator for accepting an input voltage ($V_{REF}$) and producing an output voltage ($V_{OUT}$), the voltage regulator comprising:

an operational amplifier having a first input, a second input, and an output, the first input accepting the input voltage ($V_{REF}$), wherein the operational amplifier introduces a first pole (P1);

an output amplifier having an input coupled to the output of the operational amplifier and an output that produces the output voltage ($V_{OUT}$), the output being coupled to a feedback path that produces a feedback voltage ($V_{FB}$) that is applied to the second input of the operational amplifier, wherein the output amplifier introduces a second pole (P2);

a compensation capacitor ($C_c$) having a first terminal and a second terminal, the first terminal coupled to the output of the output amplifier; and a buffer amplifier having an input coupled to the second terminal of the compensation capacitor ($C_c$), and having an output coupled directly or indirectly to the input of the output amplifier, the buffer amplifier introducing a Left Hand Plane (LHP) zero ($LHP_{ZERO}$) and having a transconductance ($gm_{BUF}$) that is controlled to be proportional to a load current ($I_{LOAD}$) such that the LHP zero ($LHP_{ZERO}$) cancels the second pole (P2).

2. The voltage regulator of claim 1 wherein the transconductance ($gm_{BUF}$) is proportional to a bias current ($I_{BIAS}$) being supplied to the buffer amplifier and wherein the bias current ($I_{BIAS}$) being supplied to the buffer amplifier is proportional to the load current ($I_{LOAD}$).

3. The voltage regulator of claim 1 wherein $$gm_{BUF} = \frac{2 * I_{bias}}{V_{gs} - V_t}$$

and wherein a bias current ($I_{BIAS}$) is controlled such that the LHP zero ($LHP_{ZERO}$) cancels the second pole (P2).

4. The voltage regulator of claim 3 wherein the bias current ($I_{BIAS}$) is provided according to the equation $$I_{bias} = \frac{(V_{gs} - V_t)}{2V_{out}} I_{LOAD}.$$

5. A voltage regulator for accepting an input voltage ($V_{REF}$) and producing an output voltage ($V_{OUT}$), the voltage regulator comprising:

a first P-Type Metal Oxide Semiconductor (PMOS) transistor (M1) having a source, drain, and gate, the source being coupled to a first supply ($V_{SUPPLY}$);

a second PMOS transistor (M2) having a source, drain, and gate, the source coupled to the first supply ($V_{SUPPLY}$) and the gate being coupled to the gate of the first PMOS transistor (M1);

a first current source having a first terminal and a second terminal, the second terminal being coupled to ground, the first current source providing a bias current ($I_{BIAS}$);

a first N-Type Metal Oxide Semiconductor (NMOS) transistor ($Mn_{1A}$) having a source, drain, and gate, the drain being coupled to the drain of the first PMOS transistor (M1) and the gate being provided with a voltage ($V_{FB}$);

a second NMOS transistor ($Mn_{1B}$) having a source, drain, and gate, the drain being coupled to the source of the first NMOS transistor ($Mn_{1A}$), the gate being provided with the voltage ($V_{FB}$), and the source being coupled to the first terminal of the first current source;

a third NMOS transistor ($Mn_{2A}$) having a source, drain, and gate, the drain being coupled to the drain of the second PMOS transistor (M2) and the gate being provided with the input voltage ($V_{REF}$);

a fourth NMOS transistor ($Mn_{2B}$) having a source, drain, and gate, the drain being coupled to the source of the third NMOS transistor ($Mn_{2A}$), the gate being provided with the input voltage ($V_{REF}$), and the source being coupled to the first terminal of the first current source;

a third PMOS transistor ($M_{OUT}$) having a source, drain, and gate, the source being coupled to the first supply ($V_{SUPPLY}$), the gate being coupled to the drain of the second PMOS transistor (M2), and the drain being coupled to an output terminal for producing the output voltage ($V_{OUT}$);

a second current source having a first terminal and a second terminal, the first terminal being coupled to the output terminal and the second terminal being coupled to ground, the second current source providing a load current ($I_{LOAD}$);

a compensation capacitor ($C_c$) having a first terminal being coupled to the output terminal and a second terminal being coupled to the drain of the fourth NMOS transistor ($Mn_{2B}$); and a feedback circuit having an input terminal coupled to the output terminal and an output terminal that produces the voltage ($V_{FB}$);

wherein the bias current ($I_{BIAS}$) is proportional to the load current ($I_{LOAD}$) according to the equation $$I_{bias} = k * I_{LOAD}.$$

6. The voltage regulator of claim 5 wherein $$k = \frac{2 * I_{bias}}{I_{load}}.$$

7. The voltage regulator of claim 5 wherein $$k = \frac{(V_{gs} - V_t)}{V_{out}}$$

wherein $V_{gs}$ is a gate-source voltage of the third NMOS transistor ($Mn_{2A}$) and $V_t$ is a threshold voltage of the third NMOS transistor ($Mn_{2A}$).

8. A voltage regulator for accepting an input voltage ($V_{REF}$) and producing an output voltage ($V_{OUT}$), the voltage regulator comprising:

a first P-Type Metal Oxide Semiconductor (PMOS) transistor (M1) having a source, drain, and gate, the source being coupled to a first supply ($V_{SUPPLY}$);

a second PMOS transistor (M2) having a source, drain, and gate, the source coupled to the first supply ($V_{SUPPLY}$) and the gate being coupled to the gate of the first PMOS transistor (M1);

a first current source having a first terminal and a second terminal, the second terminal being coupled to ground, the first current source providing a bias current ($I_{BIAS}$);

a first N-Type Metal Oxide Semiconductor (NMOS) transistor ($Mn_{1A}$) having a source, drain, and gate, the drain being coupled to the drain of the first PMOS transistor (M1) and the gate being provided with a voltage ($V_{FB}$);

a second NMOS transistor ($Mn_{1B}$) having a source, drain, and gate, the drain being coupled to the source of the first NMOS transistor ($Mn_{1A}$), the gate being provided with the voltage ($V_{FB}$), and the source being coupled to the first terminal of the first current source;

a third NMOS transistor ($Mn_{2A}$) having a source, drain, and gate, the drain being coupled to the drain of the second PMOS transistor (M2) and the gate being provided with the input voltage ($V_{REF}$);

a fourth NMOS transistor ($Mn_{2B}$) having a source, drain, and gate, the drain being coupled to the source of the third NMOS transistor ($Mn_{2A}$), the gate being provided with the input voltage ($V_{REF}$), and the source being coupled to the first terminal of the first current source;

a third PMOS transistor ($M_{OUT}$) having a source, drain, and gate, the source being coupled to the first supply ($V_{SUPPLY}$), the gate being coupled to the drain of the second PMOS transistor (M2), and the drain being coupled to an output terminal for producing the output voltage ($V_{OUT}$);

a second current source having a first terminal and a second terminal, the first terminal being coupled to the output terminal and the second terminal being coupled to ground, the second current source providing a load current ($I_{LOAD}$);

a compensation capacitor ($C_c$) having a first terminal being coupled to the output terminal and a second terminal being coupled to the drain of the fourth NMOS transistor ($Mn_{2B}$); and a feedback circuit having an input terminal coupled to the output terminal and an output terminal that produces the voltage ($V_{FB}$);

wherein the bias current ($I_{BIAS}$) is proportional to the load current ($I_{LOAD}$) and $$I_{bias} = \frac{(V_{gs} - V_t)}{2V_{out}} I_{LOAD}$$

wherein $V_{gs}$ is a gate-source voltage of the third NMOS transistor ($Mn_{2A}$) and $V_t$ is a threshold voltage of the third NMOS transistor ($Mn_{2A}$).

* * * * *